US009859611B2

(12) United States Patent
Jones et al.

(10) Patent No.: US 9,859,611 B2
(45) Date of Patent: Jan. 2, 2018

(54) ULTRA-WIDEBAND DUAL-BAND CELLULAR BASESTATION ANTENNA

(71) Applicant: CommScope Technologies LLC, Hickory, NC (US)

(72) Inventors: Bevan Beresford Jones, Epping (AU); James Kingsley Anthony Allan, Kurrajong (AU)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/040,678

(22) Filed: Feb. 10, 2016

(65) Prior Publication Data

US 2016/0254594 A1 Sep. 1, 2016

Related U.S. Application Data

(63) Continuation of application No. 13/827,190, filed on Mar. 14, 2013, now Pat. No. 9,276,329.
(Continued)

(51) Int. Cl.
*H01Q 5/00* (2015.01)
*H01Q 21/26* (2006.01)
(Continued)

(52) U.S. Cl.
CPC ..... *H01Q 1/246* (2013.01); *H01Q 5/335* (2015.01); *H01Q 5/42* (2015.01); *H01Q 19/30* (2013.01); *H01Q 21/26* (2013.01); *H01Q 21/30* (2013.01)

(58) Field of Classification Search
CPC .... H01Q 1/246; H01Q 21/061; H01Q 21/062; H01Q 21/26; H01Q 21/30; H01Q 5/40;
(Continued)

(56) References Cited

U.S. PATENT DOCUMENTS 2,976,534 A 3/1961 Kampinsky
5,952,983 A * 9/1999 Dearnley ..... H01Q 1/246 343/797
(Continued)

FOREIGN PATENT DOCUMENTS

EP 0 598 580 A1 5/1994
FR 2 863 110 6/2005
(Continued)

OTHER PUBLICATIONS

European Patent Search Report for related patent application No. EP 13192967, dated Feb. 14, 2014 (7pgs.).
(Continued)

*Primary Examiner* — Tho G Phan
*Assistant Examiner* — Patrick Holecek
(74) *Attorney, Agent, or Firm* — Myers Bigel, P.A.

(57) ABSTRACT

Ultra-wideband dual-band cellular dual-polarization base-station antennas and low-band radiators for such antennas are disclosed. The low-band radiator comprises a dipole and an extended dipole configured in a crossed arrangement, a capacitively coupled feed connecting the extended dipole to an antenna feed, and a pair of auxiliary radiating elements. The dipole comprises two dipole arms, each of approximately λ/4, for connection to the antenna feed. The extended dipole has anti-resonant dipole arms of approximately λ/2. The auxiliary radiating elements are configured in parallel at opposite ends of the extended dipole. The radiator is adapted for the frequency range of 698-960 MHz and provides a horizontal beamwidth of approximately 65 degrees. The dual-band base-station antenna comprises high-band radiators configured in at least one array and low-band radiators interspersed amongst the high-band radiators at regular intervals.

6 Claims, 5 Drawing Sheets

Related U.S. Application Data

(60) Provisional application No. 61/730,853, filed on Nov. 28, 2012.

(51) Int. Cl.

| | |
|---|---|
| ***H01Q 1/24*** | (2006.01) |
| ***H01Q 21/30*** | (2006.01) |
| ***H01Q 19/30*** | (2006.01) |
| ***H01Q 5/42*** | (2015.01) |
| ***H01Q 5/335*** | (2015.01) |

(58) Field of Classification Search

CPC .. H01Q 5/42; H01Q 5/48; H01Q 9/16; H01Q 9/18; H01Q 9/20; H01Q 1/52; H01Q 1/521; H01Q 1/523; H01Q 1/50; H01Q 5/314; H01Q 5/321; H01Q 5/335; H01Q 21/24; H01Q 21/245; H01Q 21/28; H01Q 25/001

See application file for complete search history.

(56) References Cited

U.S. PATENT DOCUMENTS

| | | | | |
|---|---|---|---|---|
| 5,966,102 | A * | 10/1999 | Runyon | H01Q 1/246 343/797 |
| 6,211,841 | B1 * | 4/2001 | Smith | H01Q 1/246 343/797 |
| 6,515,633 | B2 * | 2/2003 | Ippolito | H01Q 1/246 343/795 |
| 7,173,572 | B2 | 2/2007 | Teillet et al. | |
| 7,348,931 | B2 * | 3/2008 | Suzuki | H01Q 1/50 333/168 |
| 7,405,710 | B2 | 7/2008 | Bisiules et al. | |
| 8,289,218 | B2 * | 10/2012 | Payne | H01Q 9/28 343/725 |
| 2006/0244675 | A1 | 11/2006 | Elliot et al. | |
| 2007/0146225 | A1 * | 6/2007 | Boss | H01Q 21/08 343/797 |
| 2011/0063190 | A1 | 3/2011 | Ho et al. | |
| 2013/0271336 | A1 * | 10/2013 | Plet | H01Q 1/246 343/796 |

FOREIGN PATENT DOCUMENTS

| | | | | |
|---|---|---|---|---|
| FR | 2863111 | A1 * | 6/2005 | H01Q 1/246 |
| JP | H06 177635 | A | 6/1994 | |
| WO | WO 2011/028616 | A2 | 3/2011 | |

OTHER PUBLICATIONS

Extended European Search Report Corresponding to European Patent No. 16173630.1; dated Oct. 13, 2016; 9 Pages.

* cited by examiner

Azimuth (Low Band)

ULTRA-WIDEBAND DUAL-BAND CELLULAR BASESTATION ANTENNA

RELATED APPLICATION

This application is a continuation of, and claims priority to, and incorporates by reference U.S. application Ser. No. 13/827,190, filed Mar. 14, 2013, titled Ultra-Wideband Dual Band Cellular Basestation Antenna," which claims priority to U.S. Provisional Patent Application Ser. No. 61/730,853, the disclosure of which is incorporated by reference.

TECHNICAL FIELD

The present invention relates generally to antennas for cellular systems and in particular to antennas for cellular basestations.

BACKGROUND

Developments in wireless technology typically require wireless operators to deploy new antenna equipment in their networks. Disadvantageously, towers have become cluttered with multiple antennas while installation and maintenance have become more complicated. Base-station antennas typically covered a single narrow band. This has resulted in a plethora of antennas being installed at a site. Local governments have imposed restrictions and made getting approval for new sites difficult due to the visual pollution of so many antennas. Some antenna designs have attempted to combine two bands and extend bandwidth, but still many antennas are required due to the proliferation of many air-interface standards and bands.

SUMMARY

The following definitions are provided as general definitions and should in no way limit the scope of the present invention to those terms alone, but are set forth for a better understanding of the following description.

Unless defined otherwise, all technical and scientific terms used herein have the same meaning as commonly understood by those of ordinary skill in the art to which the invention belongs. For the purposes of the present invention, the following terms are defined below:

The articles "a" and "an" are used herein to refer to one or to more than one (i.e. to at least one) of the grammatical object of the article. By way of example, "an element" refers to one element or more than one element.

Throughout this specification, unless the context requires otherwise, the words "comprise", "comprises" and "comprising" will be understood to imply the inclusion of a stated step or element or group of steps or elements, but not the exclusion of any other step or element or group of steps or elements.

In accordance with an aspect of the invention, there is provided a low-band radiator of an ultra-wideband dual-band dual-polarisation cellular base-station antenna. The dual bands comprise low and high bands, as defined hereinafter. The low-band radiator comprises: a dipole comprising two dipole arms, each dipole arm resonant at approximately a quarter-wavelength ($\lambda/4$), adapted for connection to an antenna feed; an extended dipole with anti-resonant dipole arms, each dipole arm of approximately a half-wavelength ($\lambda/2$), the dipole and extended dipoles being configured in a crossed arrangement; a capacitively coupled feed connected to the extended dipole for coupling the extended dipole to the antenna feed; and a pair of auxiliary radiating elements, configured in parallel at opposite ends of the extended dipole, wherein the dipole and the pair of auxiliary radiating elements together produce a desired narrower beamwidth.

The low-band radiator may comprise a center feed for the dipole and extended dipole comprising two crossed printed circuit boards, one printed circuit board implementing a connection between the dipole having dipole arms of a quarter-wavelength ($\lambda/4$) and the antenna feed, and the other printed circuit board having the capacitively coupled feed implemented thereon between the extended dipole and the antenna feed.

The dipole arms may be implemented using lengths of metal cylinders, or printed circuit boards with metalisation forming the dipole arms, for example.

The auxiliary radiating elements may comprise tuned parasitic elements. Such tuned parasitic elements may each be a dipole formed on a printed circuit board with metalisation formed on the printed circuit board, an inductive element formed between arms of the dipole. Alternatively, the auxiliary radiating elements may comprise driven dipole elements.

The low-band radiator may be adapted for the frequency range of 698-960 MHz.

The low-band radiator may be used as a component in a dual-band antenna with an operating bandwidth greater than 30% and a horizontal beamwidth in the range 55° to 75°. Still further, the horizontal beamwidths of the two orthogonal polarisations may be in the range of 55 degrees to 75 degrees. Even still further, the horizontal beamwidths of the two orthogonal polarisations may be in the range of 60 degrees to 70 degrees. Preferably, the horizontal beamwidths of the two orthogonal polarisations are approximately 65 degrees.

The capacitively coupled feed may comprise a series inductor and capacitor.

In accordance with a further aspect of the invention, there is provided an ultra-wideband cellular dual-polarisation dual-band base-station antenna. The dual band has low and high bands suitable for cellular communications. The dual-band antenna comprises: a number of low-band radiators as recited hereinbefore, each adapted for dual polarisation and providing clear areas on a groundplane of the dual-band antenna for locating high band radiators in the dual-band antenna; and a number of high band radiators each adapted for dual polarisation, the high band radiators being configured in at least one array, the low-band radiators being interspersed amongst the high-band radiators at predetermined intervals. Each high-band radiator may be adapted to provide a beamwidth of approximately 65 degrees.

The high-band radiators may be adapted for the frequency range of 1710 to 2690 MHz.

BRIEF DESCRIPTION OF DRAWINGS

Arrangements of ultra-wideband dual-band cellular base-station antennas are described hereinafter, by way of an example only, with reference to the accompanying drawings, in which.

DETAILED DESCRIPTION

Figure 1:
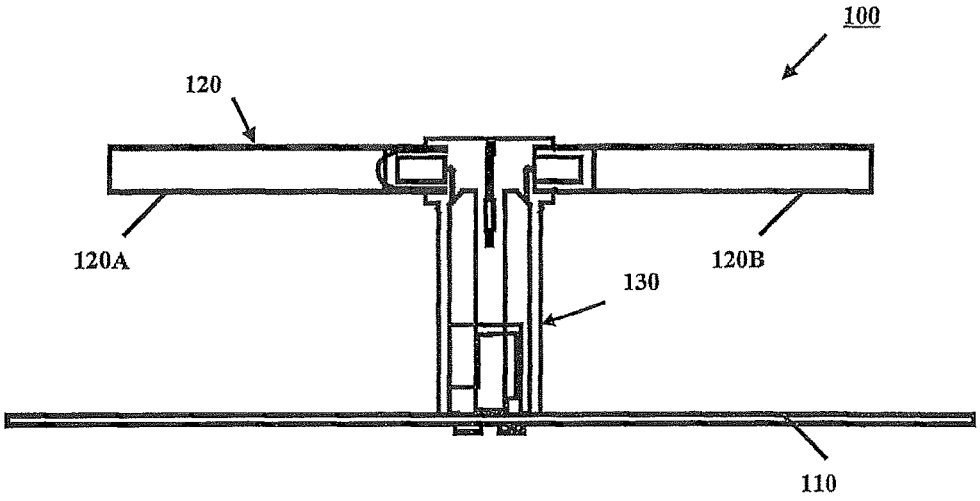
FIG. 1 is a side-elevation view of a portion of a low-band radiator of an ultra-wideband dual-band cellular base-station antenna comprising an extended dipole with anti-resonant dipole arms in accordance with an embodiment of the invention.

Ultra-wideband dual-band cellular base-station antennas and low-band radiators for such antennas are disclosed hereinafter. In the following description, numerous specific details, including particular horizontal beamwidths, air-interface standards, dipole arm shapes and materials, and the like are set forth. However, from this disclosure, it will be apparent to those skilled in the art that modifications and/or substitutions may be made without departing from the scope and spirit of the invention. In other circumstances, specific details may be omitted so as not to obscure the invention.

As used hereinafter, "low band" refers to a lower frequency band, such as 698-960 MHz, and "high band" refers to a higher frequency band, such as 1710 MHz-2690 MHz. A "low band radiator" refers to a radiator for such a lower frequency band, and a "high band radiator" refers to a radiator for such a higher frequency band. The "dual band" comprises the low and high bands referred to throughout this disclosure.

The embodiments of the invention relate to ultra-wideband dual-band antennas and a low band radiator for such an antenna adapted to support emerging network technologies. The embodiments of the invention enable operators of cellular systems ("wireless operators") to use a single type of antenna covering a large number of bands, where multiple antennas were previously required. The embodiments of the invention are capable of supporting several major air-interface standards in almost all the assigned cellular frequency bands. The embodiments of the invention allow wireless operators to reduce the number of antennas in their networks, lowering tower leasing costs while increasing speed to market capability.

The embodiments of the invention help solve the hereinbefore-mentioned problems in the art of multiple antennas cluttering towers and associated difficulties with the complicated installation and maintenance of multiple antennas by, in one antenna, supporting multiple frequency bands and technology standards.

Deploying an ultra-wideband dual-band cellular base-station antenna in accordance with an embodiment of the invention can save operators time and expense during their next technology rollouts. Such an antenna provides a future-ready solution for launching a high performance wireless network with multiple air-interface technologies using multiple frequency bands. Deploying such a flexible, scalable and independently optimized antenna technology simplifies the network, while providing the operator with significant future ready capacity. Such an antenna is optimized for high performance in capacity-sensitive data-driven systems. The embodiments of the invention utilize dual orthogonal polarizations and support multiple-input and multiple-output (MIMO) implementations for advanced capacity solutions. The embodiments of the invention support multiple bands presently and in the future as new standards and bands emerge, protecting wireless operators from some of the uncertainty inherent in wireless technology evolution.

In the following description, "ultra-wideband" with reference to an antenna connotes that the antenna is capable of operating and maintaining its desired characteristics over a bandwidth of at least 30% of a nominal frequency. Characteristics of particular interest are the beam width and shape and the return loss, which needs to be maintained at a level of at least 15 dB across this band. In the present instance, the ultra-wideband dual-band antenna covers the bands 698-960 MHz and 1710 MHz-2690 MHz. This covers almost the entire bandwidth assigned for all major cellular systems.

The following embodiments of the invention support multiple frequency bands and technology standards. For example, wireless operators can deploy using a single antenna Long Term Evolution (LTE) network for wireless communications in 2.6 GHz and 700 MHz, while supporting Wideband Code Division Multiple Access (W-CDMA) network in 2.1 GHz. For ease of description, the antenna array is considered to be aligned vertically.

An antenna in accordance with an embodiment of the invention provides a dual-band solution, which can for example add five lower frequency bands making the antenna capable of supporting nine frequency bands across the wireless spectrum for all four air-interface standards: Global System for Mobile Communications (GSM), Code Division Multiple Access (CDMA), W-CDMA and LTE. Other relevant interfaces include WiMax and GPRS. In one implementation, the antenna may be a 10-port, 2.5 meter device, for example.

Figure 2:
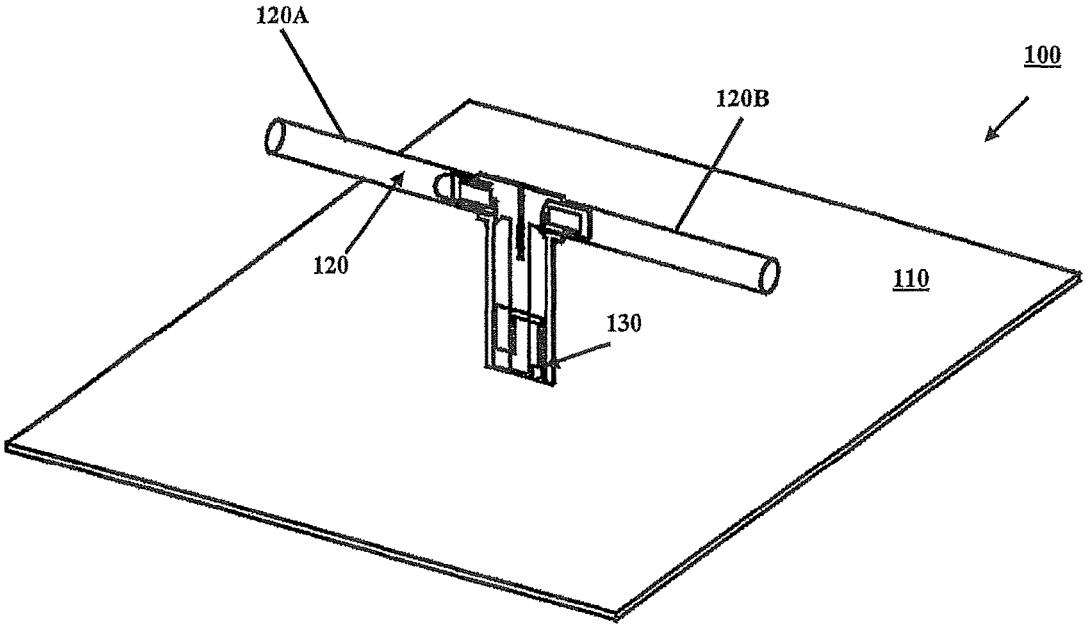
FIG. 2 is an isometric view of a low-band radiator of the ultra-wideband dual-band cellular base-station antenna shown in FIG. 1.
Figure 3:
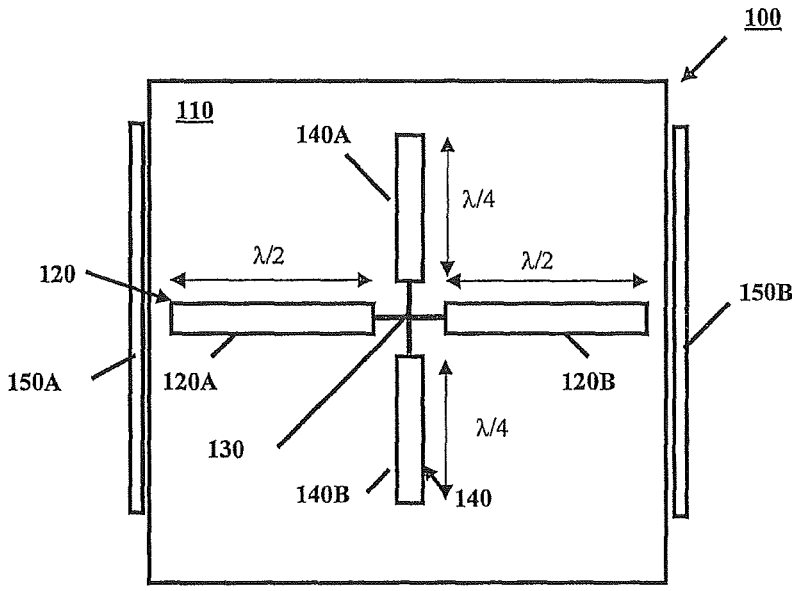
FIG. 3 is a top plan view of the entire low-band radiator of the ultra-wideband dual-band cellular base-station antenna of FIG. 1.

FIGS. 1 to 3 illustrate a low-band radiator of an ultra-wideband dual-band cellular base-station antenna 100 in accordance with an embodiment of the invention. Such a low band radiator 100 comprises a conventional dipole 140 and an extended dipole 120 configured in a crossed-dipole arrangement with crossed center feed 130. The dipole 140 comprises two dipole arms 140A and 140B resonant at approximately a quarter-wavelength ($\lambda/4$) that may be connected directly to an antenna feed (not shown) by center feed 130. Center feed 130 comprises two interlocked, crossed printed circuit boards (PCB) having feeds formed on respective PCBs for dipole 120, 140. One printed circuit board implements the connection between the dipole 140 and the antenna feed, and the other printed circuit board has the capacitively coupled feed implemented thereon between the extended dipole 120 and the antenna feed. The antenna feed may be a balun, of a configuration well known to those skilled in the art. The connection between the conventional dipole 140 and the antenna feed may be of a standard configuration for dipoles.

The extended dipole 120 is an elongated dipole with anti-resonant dipole arms 120A and 120B each having a length of approximately half a wavelength ($\lambda/2$). As shown in FIG. 3, the dipole 140 and the extended dipole 120 are configured in a crossed arrangement. The anti-resonant dipole arms 120A and 120B of extended dipole 120 are capacitively coupled by the crossed center feed 130 to the antenna feed (not shown). The capacitive coupling (a series inductor and capacitor) can be implemented on protuberant arms of the PCB of the center feed 130 that are inserted into the extended dipole 120. The dipole 140 is coupled by tracks on the PCB that are inserted into the tubes (dipole arms 140A, 140B). The tracks are fed through inductive tracks to the antenna feed (balun). FIGS. 1 and 2 show only the extended dipole 120 and the PCB of the center feed 130 for that dipole 120; the conventional dipole 140 is omitted in these drawings to simplify the drawing. The dipole arms of the dipoles 120, 140 may be implemented using hollow metal cylinders, where protuberant arms of the PCB are inserted into respective ends of the metal cylinders. For the extended dipole 120, the capacitively coupled feed is implemented on the protuberant arms of the PCB inserted into the dipole arms 120A, 120B to provide the capacitive coupling. While the dipoles are depicted being made of hollow metal tubes, other dipoles may be implemented including metalised portions, or simply metalisation, on a printed circuit board, for example. The purpose of the series inductance and capacitance is in combination with the impedance characteristics of the antiresonant dipole arms 120A, 120B to form a bandpass filter having the required bandwidth.

As shown in FIGS. 1 and 2, the center feed 130 suspends the extended dipole 120 above a metal groundplane 110, by preferably a quarter wavelength above the groundplane 110. The center feed 130 may be connected to the antenna feed (not shown) on the opposite side of the groundplane 110 from the side where the dipoles 120, 140 are located. A pair of auxiliary radiating elements 150A and 150B, such as tuned parasitic elements or dipoles, or driven dipoles, is located in parallel with the conventional dipole 140 at opposite ends of the extended dipole 120. The tuned parasitic elements may each be a dipole formed on a PCB with metalisation formed on the PCB, an inductive element formed between arms of that dipole on the PCB. An inductive element may be formed between the metal arms of the parasitic dipoles 150A, 150B to adjust the phase of the currents in the dipole arms to bring these currents into the optimum relationship to the current in the driven dipole 140. Alternatively, the auxiliary radiating elements may comprise driven dipole elements. The dipole 140 and the pair of auxiliary radiating elements 150 together produce a desired narrower beamwidth.

Figure 7:
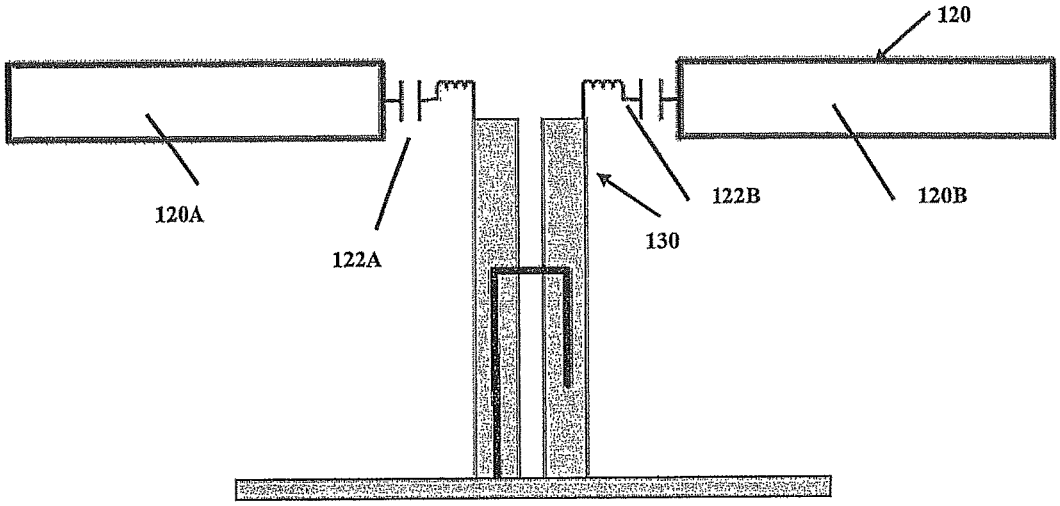
FIG. 7 is a schematic diagram of a matching circuit for the (horizontal) extended dipole of FIGS. 1-5.

FIG. 7 is a schematic diagram illustrating in detail the series capacitors and inductors 122A, 122B implemented on PCB 130 to capacitively fed dipole arms 120A and 120B. The capacitor is a short track within the dipole tube. The inductor is a thin track connecting to the balun.

The dipole 140 is a vertical dipole with dipole arms 140A, 140B that are approximately a quarter wavelength ($\lambda/4$), and the extended dipole 120 is a horizontal dipole with dipole arms 120A, 120B that are approximately a half wavelength ($\lambda/2$) each. The auxiliary radiating elements 150A and 150B, together with the dipole 140, modify or narrow the horizontal beamwidth in vertical polarisation.

The antenna architecture depicted in FIGS. 1 to 3 provides the low band radiator 100 of an ultra-wideband dual-band cellular base-station antenna having crossed dipoles 120, 140 oriented in the vertical and horizontal directions located at a height of about a quarter wavelength above the metal groundplane 110. This antenna architecture provides a horizontally polarized, desired or predetermined horizontal beamwidth and a wideband match over the band of interest. The pair of laterally displaced auxiliary radiating elements (e.g., parasitic dipoles) 150A, 150B together with the vertically oriented driven dipole 140 provides a similar horizontal beamwidth in vertical polarization. The low-band radiator may be used as a component in a dual-band antenna with an operating bandwidth greater than 30% and a horizontal beamwidth in the range 55° to 75°. Still further, the horizontal beamwidths of the two orthogonal polarisations may be in the range of 55 degrees to 75 degrees. Preferably, the horizontal beamwidths of the two orthogonal polarisations may be in the range of 60 degrees to 70 degrees. Most preferably, the horizontal beamwidths of the two orthogonal polarisations are approximately 65 degrees.

The dipole 120 has anti-resonant dipole arms 120A, 120B of length of approximately $\lambda/2$ with a capacitively coupled feed with an 18 dB impedance bandwidth >32% and providing a beamwidth of approximately 65 degrees. This is one component of a dual polarised element in a dual polar wideband antenna, The single halfwave dipole 140 with the two parallel auxiliary radiating elements 150A, 150B to provide the orthogonal polarization to signal radiated by extended dipole 120. The low-band radiator 100 of the ultra-wideband dual-band cellular base-station antenna is well suited for use in the 698-960 MHz cellular band. In the description that follows, an ultra-wideband dual-band cellular base-station antenna 100 of the type shown in FIG. 3 (as well as FIGS. 1 and 2) will be referred to as the low band radiator. A particular advantage of this configuration is that this the low band radiator 100 leaves unobstructed regions or clear areas of the groundplane where the high-band radiators of the ultra-wideband dual-band antenna can be located with minimum interaction with the low-band radiators.

The low-band radiators of the antenna as described radiate vertical and horizontal polarizations. For cellular basestation antennas, dual slant polarizations (linear polarizations inclined at +45° and −45° to vertical) are conventionally used. This can be accomplished by feeding the vertical and horizontal dipoles of the low-band radiator from a wideband 180° hybrid (i.e., an equal-split coupler) well known to those skilled in the art.

A particular advantage of this configuration of the low band radiators is that unobstructed regions of the groundplane are left that allow placement of high band radiators with minimum interaction between the low band and high band radiators.

Figure 4:
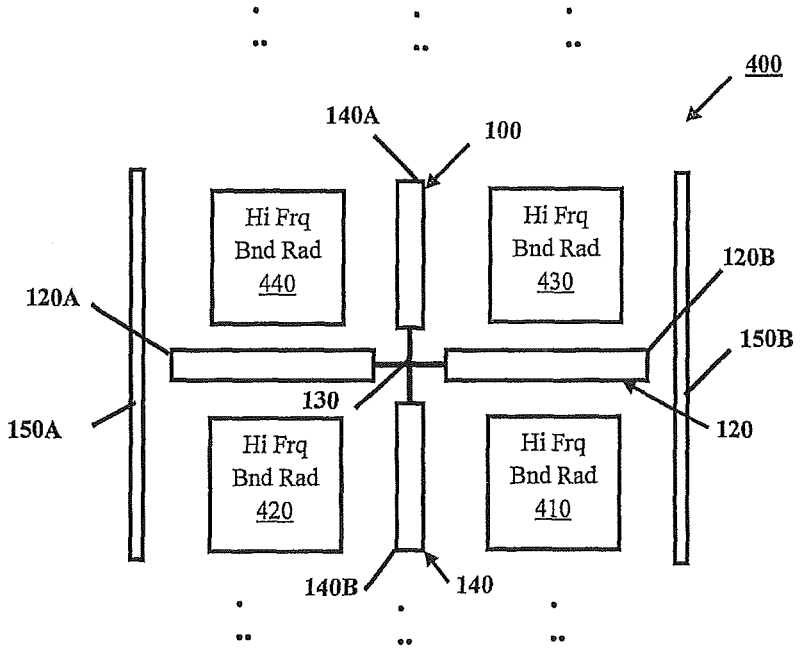
FIG. 4 is a simplified top-plan view of a portion or section of an ultra-wideband, dual-band cellular base-station antenna in accordance with another embodiment of the invention comprising high-band and low-band radiators, where the low-band radiator is of the type shown in FIGS. 1 to 3, and the high-band radiators are configured in one or more arrays.
Figure 5:
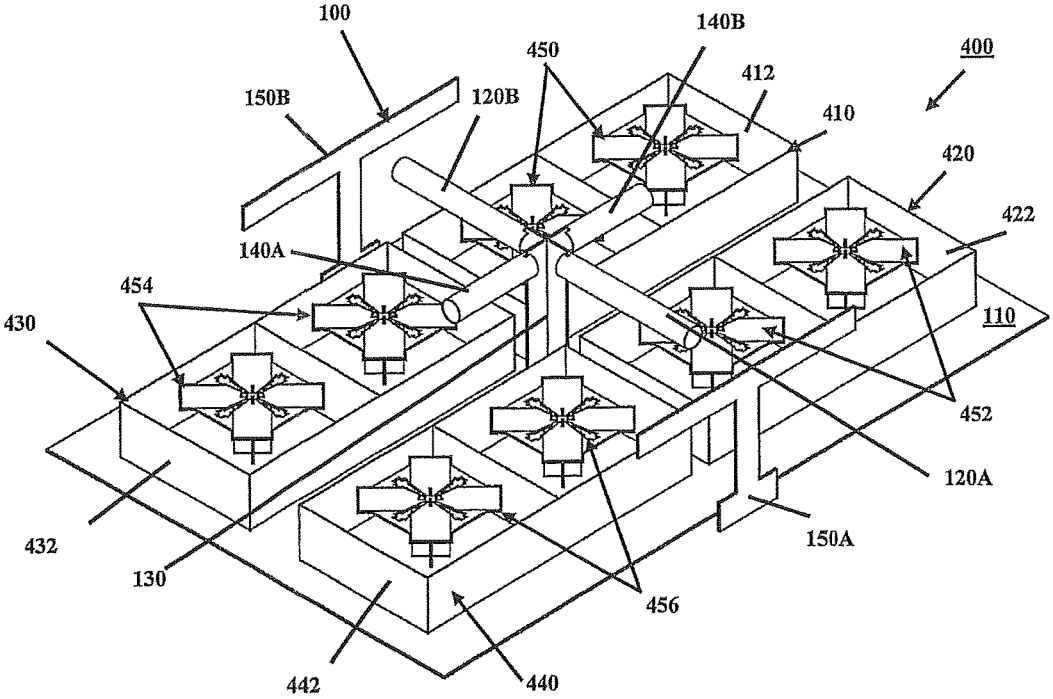
FIG. 5 is a detailed perspective view of a portion or section of the ultra-wideband, dual-band cellular base-station antenna comprising high-frequency band and low-frequency band antenna elements of FIG. 4.
Figure 6:
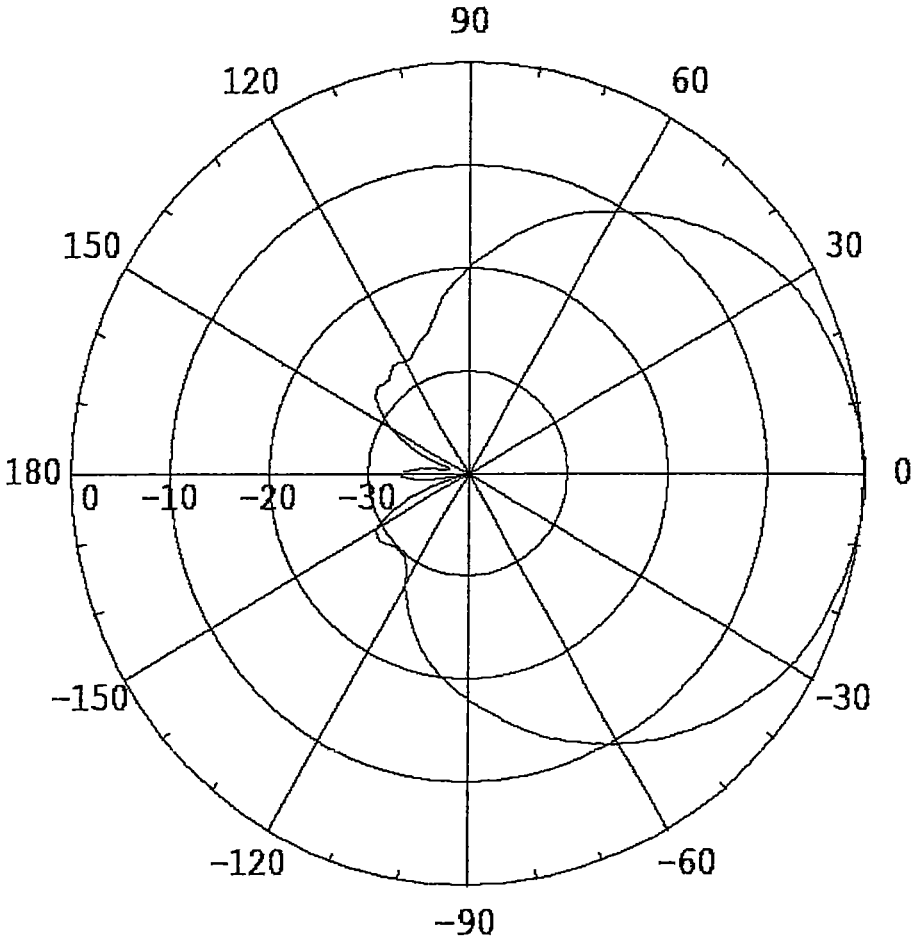
FIG. 6 is a polar plot of the azimuth radiation pattern of the low-band radiator of FIG. 5.

FIG. 4 illustrates a portion or section of an ultra-wideband, dual-band dual-polarisation cellular base-station antenna comprising four high-band radiators 410, 420, 430, 440 arranged in a 2×2 matrix with the low-band radiator 100 of the type shown in FIGS. 1-3. A single low-band radiator 100 is interspersed at predetermined intervals with these four high band radiators 410, 420, 430, 440. The features of the low-band radiator 100 illustrated in FIGS. 1 to 3 are illustrated in FIGS. 4 and 5 with the same reference numerals. For the sake of brevity only, the description of the features in FIGS. 4 and 5 are not repeated here where those features are the same as those shown in FIGS. 1-3. The crossed-dipoles 120 and 140 define four quadrants, where the high-band radiators 420 and 410 are located in the lower-left and lower-right quadrants, and the high-band radiators 440 and 430 are located in the upper-left and upper-right quadrants. The low-band radiator 100 is adapted for dual polarization and provides clear areas on a groundplane 110 of the dual-band antenna 400 for locating the high band radiators 410, 420, 430, 440 in the dual-band antenna 400. Ellipsis points indicate that a base-station antenna may be formed by repeating portions 400 shown in FIG. 4. The wideband high-band radiators 440, 420 to the left of the centreline comprise one high band array and those high-band radiators 430, 410 to the right of the centreline defined by dipole arm s 140A and 140B comprise a second high band array. Together the two arrays can be used to provide MIMO capability in the high band. Each high-band radiator 410, 420, 430, 440 may be adapted to provide a beamwidth of approximately 65 degrees.

FIG. 5 illustrates in greater detail the portion or section 400 of the antenna shown in FIG. 4. In particular, an implementation of the four high-band radiators 410, 420, 430, 440 is shown in detail. Each high-band radiator 410, 420, 430, 440 comprises a pair of crossed dipoles 450, 452, 454, 456 each located in a square metal enclosure. In this case the crossed dipoles 450, 452, 454, 456 are inclined at 45° so as to radiate slant polarization. The high band radiator 410 comprises a pair of crossed-dipoles 450, each disposed in a square cell formed by dividing a rectangular metal walled enclosure 412 by a further metal wall into the two cells. The dipoles are implemented as bow-tie dipoles or other wideband dipoles. While specific configurations of dipoles are shown, other dipoles may be implemented using tubes or cylinders or as metalised tracks on a printed circuit board, for example. Likewise, the high band radiator 420 comprises a pair of crossed-dipoles 452, each disposed in a square cell formed by dividing a rectangular metal walled enclosure 422 by a further metal wall into the two cells. Still further, the high band radiator 430 comprises a pair of crossed-dipoles 454, each disposed in a square cell formed by dividing a rectangular metal walled enclosure 432 by a further metal wall into the two cells. Finally, the high band radiator 440 comprises a pair of crossed-dipoles 456, each disposed in a square cell formed by dividing a rectangular metal walled enclosure 442 by a further metal wall into the two cells. The metal walled enclosures 412, 422, 432, 442 modify the beamwidth of the corresponding dipoles 450, 452, 454, 456 of the high-band radiators 410, 420, 430, 440.

While the low-band radiator (crossed dipoles with auxiliary radiating elements) 100 can be used for the 698-960 MHz band, the high-band radiators 410, 420, 430, 440 can be used for the 1.7 GHz to 2.7 GHz (1710-2690 MHz) band. The low-band radiator 100 provides a 65 degree beamwidth with dual polarisation (horizontal and vertical polarisations). Such dual polarisation is required for base-station antennas. The conventional dipole 140 is connected to an antenna feed, while the extended dipole 120 is coupled to the antenna feed by a series inductor and capacitor. The low-band auxiliary radiating elements (e.g., parasitic dipoles) 150 and the vertical dipole 140 make the horizontal beamwidth of the vertical dipole 140 together with the auxiliary radiating elements 150 the same as that of the horizontal dipole 120. The antenna 400 implements a multi-band antenna in a single antenna.

Beamwidths of approximately 65 degrees are preferred, but may be in the range of 60 degrees to 70 degrees on a single degree basis (e.g., 60, 61, or 62 degrees).°. FIG. 7 illustrates an azimuth pattern for the low-band radiator 100.

This ultra-wideband, dual-band cellular base-station antenna can be implemented in a limited physical space.

Thus, ultra-wideband multi-band cellular base-station antennas and a low-band radiator for such an antenna described herein and/or shown in the drawings are presented by way of example only and are not limiting as to the scope of the invention. Unless otherwise specifically stated, individual aspects and components of the antennas may be modified, or may have been substituted therefore known equivalents, or as yet unknown substitutes such as may be developed in the future or such as may be found to be acceptable substitutes in the future.

What is claimed is:

1. An ultra-wideband cellular, dual-polarization dual-band basestation antenna having a low band and a high band suitable for cellular communications, the dual-band antenna comprising:

at least one low band radiator having a crossed dipole configuration including a vertical dipole with two dipole arms and a horizontal dipole with two dipole arms located above a vertically-extending groundplane, forming clear regions on the groundplane, to provide vertical and horizontal polarization;

a plurality of high band radiators each comprising a crossed dipole and inclined at 45° so as to radiate slant polarization, the high band radiators located within the clear regions on the groundplane of the dual-band antenna, wherein the at least one low band radiator having the crossed dipole configuration defines four quadrants including a lower-left quadrant, a lower-right quadrant, an upper-left quadrant and an upper-right quadrant when the low band radiator is viewed in plan view, and a respective one of the high-band radiators is located in each of the four quadrants, wherein the at least one low band radiator further includes a pair of auxiliary radiating elements that are perpendicular to and at opposite ends of the horizontal dipole, wherein said auxiliary radiating elements comprise tuned parasitic elements, and wherein said tuned parasitic elements are each a dipole having a pair of arms formed on a printed circuit board with metalisation, each parasitic element including an inductive element formed between the arms of said dipole.

2. A dual-polarization, dual-band base station antenna having a low band and a high band suitable for cellular communications, the dual-band antenna comprising:

a low band radiator extending above a vertically-extending groundplane, the low band radiator including a vertical dipole with two dipole arms and a horizontal dipole with two dipole arms that are arranged in a crossed dipole configuration, the low band radiator configured to radiate at vertical and horizontal polarizations;

a plurality of high band radiators, each high band radiator comprising a crossed dipole and inclined at 45° so as to radiate at −45°/+45° slant polarizations, the high band radiators located within respective clear regions on the groundplane of the dual-band antenna, wherein a length of the horizontal dipole is approximately twice a length of the vertical dipole.

3. The dual-band antenna of claim 2, the low band radiator further comprising a pair of auxiliary radiating elements that are perpendicular to and at opposite ends of the horizontal dipole.

4. The dual-band antenna of claim 3, wherein first and second of the high band radiators are located between the vertical dipole and a first of the parasitic elements, and third and fourth of the high band radiators are located between the vertical dipole and a second of the parasitic elements.

5. The dual-band antenna of claim 2, wherein a respective one of the high-band radiators is located in each of four quadrants that are defined by the crossed dipole configuration of the low band radiator.

6. The dual-band antenna of claim 2, wherein the high band radiators are positioned in a 2×2 array above the groundplane and a center feed for the low band radiator is located at a center of the 2×2 array.

* * * * *